United States Patent [19]

Kerr

[11] Patent Number: 4,592,157

[45] Date of Patent: Jun. 3, 1986

[54] VEHICLE IDENTIFICATION AND RETRIEVAL SYSTEM

[76] Inventor: Charles J. Kerr, 605 S. Barrington, Los Angeles, Calif. 90049

[21] Appl. No.: 663,225

[22] Filed: Oct. 22, 1984

[51] Int. Cl.[4] ..... A44C 3/00

[52] U.S. Cl. ..... 40/2 A

[58] Field of Search ..... 40/2 R, 2 A, 10 R, 330

[56] References Cited

U.S. PATENT DOCUMENTS

| | | | |
|---|---|---|---|
| 653,267 | 7/1900 | Short | 40/2 A |
| 1,172,602 | 2/1916 | Johnson | 40/2 R |
| 1,236,436 | 8/1917 | Horn | 40/2 R |
| 2,511,651 | 6/1950 | Schlitz | 40/2 A |
| 2,589,349 | 3/1952 | Diefenbach | 206/818 |
| 3,086,268 | 4/1963 | Chaffin | 40/2 A |

*Primary Examiner*—Gene Mancene
*Assistant Examiner*—Wenceslao J. Contreras
*Attorney, Agent, or Firm*—Lyon & Lyon

[57] ABSTRACT

An identification and retrieval system for vehicles incorporating a first, second and third identification means said first and third identification means being constructed from a magnetic material, said first identification means being utilized to identify the vehicle's keys, the second identification means being utilized by the vehicle driver to identify his particular vehicle and the third identification means being utilized to identify the vehicle.

1 Claim, 9 Drawing Figures

VEHICLE IDENTIFICATION AND RETRIEVAL SYSTEM

FIELD OF INVENTION

This invention relates to the field of identification and retrieval systems utilized in the temporary storage and subsequent quick retrieval of motor vehicles. In particular, this invention relates to storage and retrieval systems utilized in automobile valet parking systems.

BACKGROUND OF INVENTION

This invention provides for a reliable and quick identification and retrieval system for use in connection with the typical valet parking system presently utilized by the vast majority of restaurants and other establishments offering their patrons valet parking.

Prior systems have traditionally consisted of a plurality of identification cards, usually two (2) small rectangular or squared shaped pieces of paper or cardboard. The two cards bear the same identification number. Upon a patron's arrival at the restaurant, the parking valet would hand the driver one of the numbered cards and upon parking the patron's vehicle would return to a central location at which the keys of the parked automobiles would be stored for safekeeping. The keys of a particular vehicle would be placed in a compartment within this storage facility along with the second numbered identification card. When the patron was ready to exit the premises, he returned his numbered identification card to the parking attendant who would in turn retrieve the patron's keys from the storage area by locating the matching identification card. The attendant then retrieves the patron's vehicle from the parking lot and returns it to the patron at the front of the restaurant.

Prior systems such as that just described are old in the art. These systems all suffer from a common shortfall. They lack reliability and quickness. Experience has shown that during the peak hours at popular restaurants, patrons are generally arriving at a faster rate than the parking attendants can park the cars and return the car keys and identification card to the storage area. Accordingly, it is common practice for the valet services to "stack" vehicles near the entrance of the restaurant until a lull occurs in the volume of incoming patrons at which time the attendants will then park several vehicles in succession without returning to the central storage area between the parking of each vehicle. The attendants commonly put one vehicle's keys and identification card in their pocket while they park a second or third vehicle. In doing so, the identification cards and keys of the several vehicles frequently become mixed up and upon the attendant's return to the central storage facility, the identification cards are frequently matched with the wrong set of keys. This mix-up leads to the retrieval of the wrong vehicle upon the patron's attempted departure.

A second problem arising under the prior system is the amount of time needed to retrieve the vehicles. When attempting to retrieve a particular patron's vehicle, the attendant generally has nothing more to guide him than the knowledge of the general make of the vehicle to enable him to quickly retrieve the vehicle. Frequently there are several vehicles of the same make in the parking lot and the attendant may initially attempt to retrieve the wrong vehicle. Also, in the evening it may be sufficiently dark outside that even knowledge of the color of the patron's vehicle is not helpful in enabling the quick location of the vehicle in question until the attendant is actually almost upon the vehicle.

A need, therefore, exists for a reliable identification and quick retrieval system for use by valet parking systems. The need exists for a system which eliminates the improper identification of a patron's vehicle keys and which also decreases the time necessary for the attendant's retrieval of the patron's vehicle.

SUMMARY OF THE INVENTION

This invention solves the need for a reliable and quick vehicle identification and retrieval system. The invention is comprised of three identification cards each bearing the same identification number. Two of the identification cards have a magnetic surface which causes the cards to adhere to one another or to a metallic surface such as a vehicle or automobile fender. The third identification card is a simple plastic card similar in shape to a standard credit card.

In operation, the three identification cards are stored together as a single unit with the magnetic surfaces of the two cards facing each other and the plastic card placed between them. The magnetic strength of the two outer cards is sufficient to hold the three cards together in a layered configuration. A clip mechanism is attached to one of the magnetic cards. When a patron arrives, he is handed the plastic identification card. The attendant then clips the one magnetic card to the vehicle's key ring and places the remaining magnetic card on the fender of the vehicle. Later when the vehicle is parked, the attendant returns the keys, with the identification card clipped to them, to the central storage area. Since the identification card is clipped to the vehicle's key ring the parking valet may safely place several vehicle's keys in his pocket before returning to the central storage area without fear of inadvertently mismatching the keys and identification tags. When it is time to retrieve the vehicle, the attendant can do so very quickly by simply locating the matching identification card attached to the vehicle fender.

Thus, it is an object of this invention to provide a reliable identification and retrieval system for use with a valet parking system.

It is also an object of this invention to provide for a quick identification and retrieval system for use with a valet parking system.

DETAILED DESCRIPTION

Figure 1:
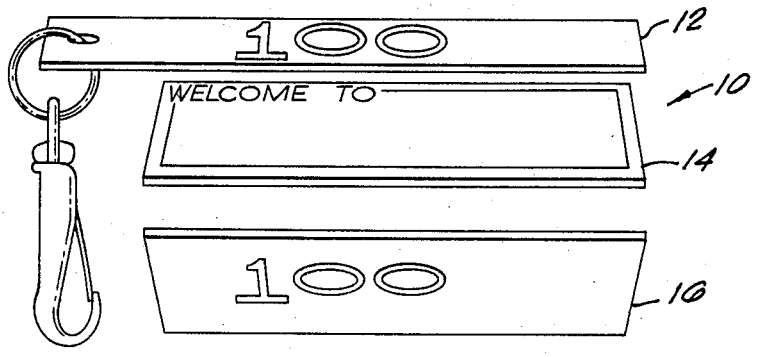
FIG. 1 is an exploded perspective view of the invention.
Figure 2:
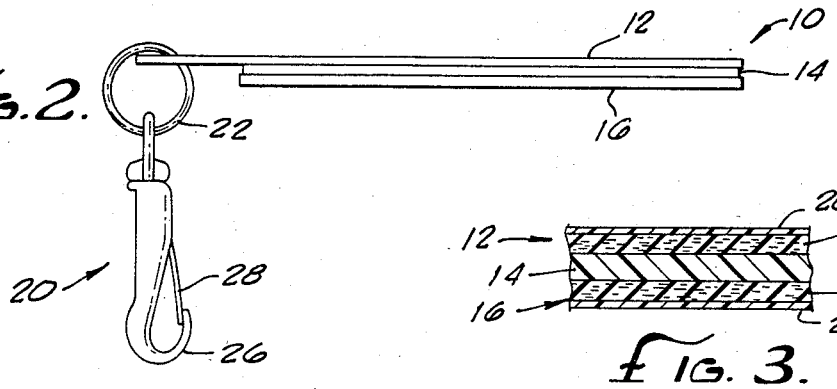
FIG. 2 is a side view of the invention.

The combined elements of the identification and retrieval system 10 are shown in FIGS. 1 and 2. The system 10 is comprised of three elements: the key identification tag 12; the patron card 14 and the vehicle identification card 16. The key identification tag 12 and the vehicle identification card 16 are both constructed from a sheet of pliable magnetic material 18. A readily available material which is satisfactory for this purpose is magnetic vinyl. On both the key identification tag 12 and the vehicle identification card 16, one side of the magnetic material 18 is coated with a thin flexible non-magnetic plastic layer 20. Matching identifying numbers are placed on the non-magnetic surface of each of these two elements. For purposes of explanation, the numeral 100 has been shown on these elements in the drawings.

Figure 3:
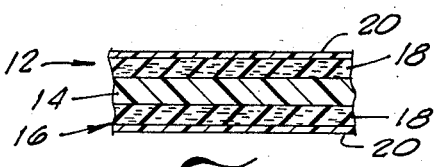
FIG. 3 is a cross-sectional partial side view of the invention.

When not in use, the combined elements of the system 10 are stored in the manner shown in FIGS. 2 and 3. The customer's identification card 14 is placed between the key identification tag 12 and the vehicle identification card 16 which are arranged so that their respective magnetic surfaces 18 are adjacent to the customer card 14. In the preferred embodiment, the magnetic attraction of materials 18 is of a sufficient strength that the magnetic surfaces 18 will hold the customer card 14 in place between them forming a layered combination as shown in FIG. 2.

Figure 4:
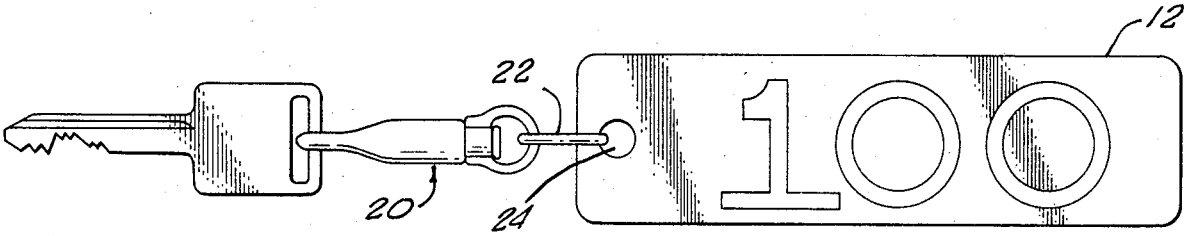
FIG. 4 is a top view of the key identification tag.
Figure 7:
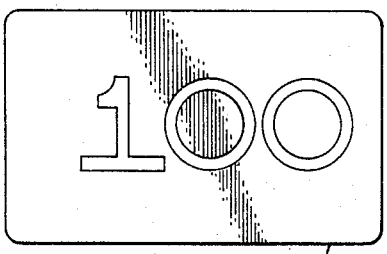
FIG. 7 is a top view of the vehicle identification tag.
Figure 5:
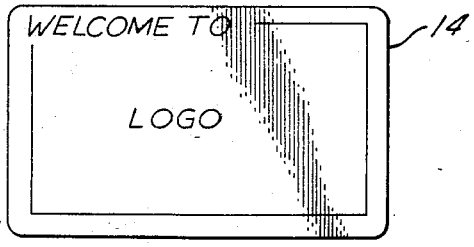
FIG. 5 is a top view of the patron card.
Figure 6:
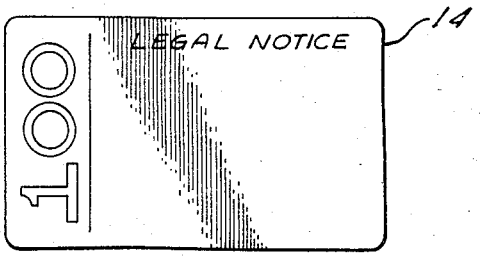
FIG. 6 is a bottom view of the patron card.

In actual use, a plurality of the systems 10 are kept in a central storage or security area. Upon the arrival of a patron the valet attendant removes one of the combined elements of the system 10 from the storage area. The attendant removes the plastic patron's card 14 from between the key identification tag 12 and the vehicle identification card 16 and hands the patron card 14 to the patron. As shown in FIGS. 5 and 6, the patron card 14 has the restaurant name or logo on one side and an identification number on the other side. The patron card 14 is constructed from any suitable plastic similar to a standard credit card. The patron card 14 should be completely non-magnetic thereby allowing the patron to place the card in his pocket or wallet without accidentally erasing the magnetic strip contained on the back of normal credit cards. The attendant then parks the vehicle and when exiting the vehicle, removes the keys and attaches the key identification tag 12 to the keys by means of a key clip 20 as shown in FIG. 4. The key clip 20 is attached to the key identification tag 12 by any suitable means. In one embodiment, as shown in FIGS. 1, 2 and 3, the key clip 20 is attached to the key identification tag 12 by means of a ring 22 which passes through an aperture 24 in the end of the tag 12. As shown in FIGS. 1 and 2, the key identification tag 12 is of a greater length than the customer card 14 and the vehicle identification card 16. This extra length allows for the attachment of the key clip 20 without interfering with the layered combination of the system. In the embodiment shown in FIGS. 1, 2 and 3, the key clip 20 has a spring-loaded hook-end 26. The key is held in place on the hook-end 26 by means of a leaf-spring 28. Spring-loaded hooks such as that used in the key clip 20 are known in the art.

Upon exiting the vehicle and attaching the key identification tag 12 to the vehicle keys, the valet attendant then attaches the magnetic vehicle identification card 16 to the body or fender of the vehicle. The attendant is then free to park additional cars. During those times in which the volume of arriving patrons is of a level which prevents the vehicles from immediately being parked, the key identification tag 12 and the vehicle identification card 16, which are still held together by the magnetic surfaces 18 may be dropped on the driver's seat or otherwise suitably placed within the vehicle. When the level of business drops to an acceptable level, the attendant may then park the car. Due to the magnetic strips 18 holding the key identification tag 12 and vehicle identification card 16 together, they will not have become separated or mixed up thereby insuring the accuracy of the vehicle identification system. Further, when the attendant has attached the key identification tag 12 to the vehicle's keys, he or she can safely park a plurality of vehicles without worrying about the various sets of keys and identification tags becoming mis-matched as was a problem with prior systems.

Upon completion of parking the vehicle or vehicles, the attendant then places the vehicle keys and attached identification tag in a central storage or security area. When the patron exits the establishment, he hands his or her numbered patron card to the attendant who then retrieves the matching numbered key identification tag 12 and attached keys from the central storage location. The attendant then retrieves the patron's vehicle, aided in the quick location and identification of the vehicle by the numbered vehicle identification card 16 attached to the vehicle's fender which matches the numbered key identification tag 12 and patron card 14. Upon locating the vehicle, the attendant removes the vehicle identification card from the vehicle's fender and also removes the key identification tag from vehicle's keys and arranges the system back in its layered storage configuration.

Figure 8:
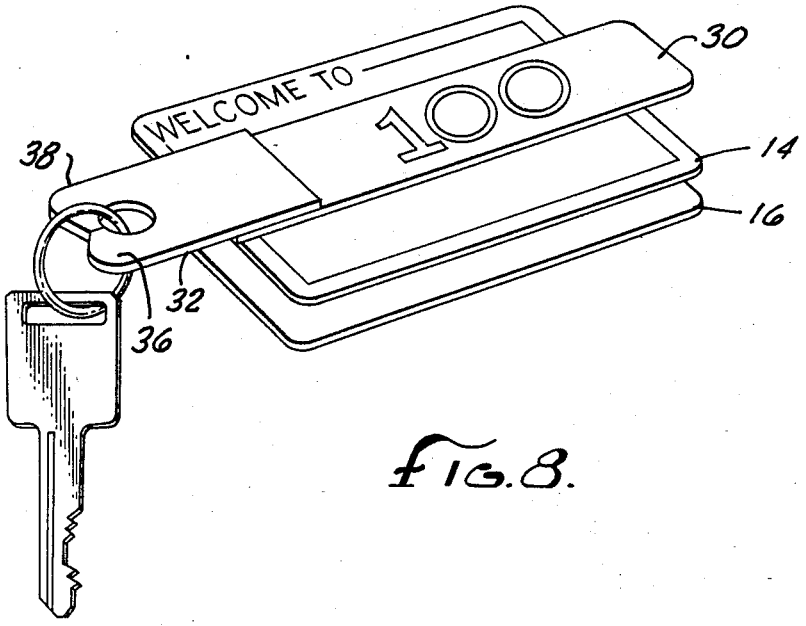
FIG. 8 is a perspective view of an alternate embodiment of the invention.
Figure 9:
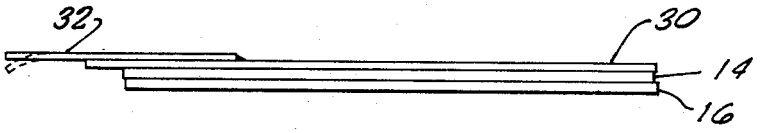
FIG. 9 is a side view of the alternate embodiment shown in FIG. 8.

An alternate embodiment of the invention is shown in FIGS. 8 and 9. In this embodiment, the key identification tag 30 is equipped with an alternate key clip 32. The key clip 32 is known in the art and is commercially available from Esco Corporation and is sold under the trademark, Kwik-Lok®. The key clip 32 has the same width as the key identification tag 30 and is attached to the top of the tag by any one of several suitable means. In one embodiment, the key clip 32 is attached to the tag 30 by means of an adhesive. In an alternate embodiment key clip 32 is attached to the tag 30 by means of a snap-rivet.

The key clip 32 has an aperture 34 located towards one end of the clip formed by two curved flexible arms 36 and 38 which come together at the front of the clip as shown in FIG. 8. The patron's key ring is attached to the clip 32 by pressing the key ring against the junction of the flexible arms 36 and 38.

Having thus described one embodiment of my invention in detail, it is to be understood that numerous equivalents and alterations which do not depart from the invention will be apparent to those skilled in the art, given the teaching herein. Thus, my invention is not to be limited to the above description, but is to be of the full scope of the appended claims.

What is claimed:

1. A method for the use of an identification and retrieval system for vehicles comprising the the use of:

a first identification means, a second identification means, and a third identification means wherein the first and third identification means are constructed from a magnetic material with the second identification means being constructed from a non-magnetic material and further wherein the first identification means includes a connector element wherein when not in use the first, second and third identification means are stored in a layered configuration with the second identification means being held between the first and third identification means which are held in a contacting layered relationship by the magnetic force emitted by the first and third identification means and further wherein the system is utilized by transferring the second identification means to the driver of the vehicle to be identified and retrieved, then parking the vehicle, removing the vehicle's keys and attaching the first identification means to the vehicle's keys by means of the connector element, and then placing the third identification means on the outer body of the parked vehicle and storing the connected first identification means and vehicle keys until the return of the vehicle's driver, then retrieving the second identification means from the vehicle driver, retrieving the first identification means and keys from storage, locating the vehicle by the third identification means, removing the first identification means from the keys, removing the third identification means from the vehicle and placing the first, second and third identification means in the layered configuration.

* * * * *